United States Patent [19]

Massoubre

[11] 3,933,441

[45] Jan. 20, 1976

[54] THIN, CONTINUOUS STEEL WIRES

[75] Inventor: Jean-Marie Massoubre, Clermont-Ferrand, France

[73] Assignee: Compagnie Generale des Establissements Michelin, raison sociale Michelin & Cie, France

[22] Filed: June 11, 1973

[21] Appl. No.: 368,823

Related U.S. Application Data

[62] Division of Ser. No. 248,569, April 28, 1972, abandoned.

[30] Foreign Application Priority Data

May 10, 1971 France ..... 71.16882

[52] U.S. Cl. ..... 29/183.5; 29/193; 75/123 L; 75/123 N

[51] Int. Cl.[2] ..... B21C 1/02

[58] Field of Search ..... 29/183.5, 193; 75/123 L, 75/123 N; 136/25

[56] References Cited

UNITED STATES PATENTS

| | | | |
|---|---|---|---|
| 1,355,368 | 10/1920 | Underwood | 29/193 |
| 2,195,256 | 3/1940 | Palmer | 75/123 L |
| 2,825,108 | 3/1958 | Pond | 29/193 |
| 3,507,711 | 4/1970 | Fisher | 29/193 X |
| 3,543,831 | 12/1970 | Schille | 164/82 |
| 3,617,230 | 11/1971 | Richards et al. | 75/123 L X |
| 3,689,329 | 9/1972 | Kern | 75/123 N X |

*Primary Examiner*—L. Dewayne Rutledge
*Assistant Examiner*—O. F. Crutchfield
*Attorney, Agent, or Firm*—Brumbaugh, Graves, Donohue & Raymond

[57] ABSTRACT

Thin, continuous steel wires are produced by solidification of a jet of liquid steel projected into a cooling fluid. The solidication is initiated and accelerated by the presence of oxygen in the cooling fluid and by selection of the relative amounts of silicon and manganese in the liquid steel so as to provide solid silica as the oxidation product which is principally formed.

2 Claims, No Drawings

THIN, CONTINUOUS STEEL WIRES

This is a divisional, of U.S. application Ser. No. 248,569, filed Apr. 28, 1972, now abandoned.

The present invention relates to the manufacture of very thin, continuous steel wires obtained by solidification of a jet of liquid steel projected into a cooling fluid.

As is known, a liquid jet which is ejected under pressure from a container provided with an orifice assumes a cylindrical shape over a certain length upon its emergence from the orifice before undergoing constrictions or oscillations, and then is divided up to give rise to drops. The length of the cylindrical portion of the jet depends on a number of parameters: shape, dimensions and physical condition of the orifice; pressure exerted on the liquid and speed of ejection; diameter of the jet; nature and properties of the liquid; nature and properties of the fluid into which the jet is projected.

To give an idea, a jet of liquid steel projected into a gaseous fluid at a temperature of between 1450°C. and 1650°C. with a diameter of 30 to 400$\mu$ and a speed of between a few meters per second and 30 to 40 meters per second assumes and retains a cylindrical shape over a length not exceeding a few centimeters, and therefore for a period of time of the order of a hundredth or thousandth of a second.

If it is desired to obtain a continuous cylindrical wire, and in particular a steel wire, from a jet of liquid steel projected into a cooling fluid, it is therefore necessary to have its solidification take place during a very short period of time. This problem is particularly difficult to solve in the case of iron or steel whose properties, as compared with those of other metals, do not favor rapid solidification, namely high specific heat, low heat conductivity, high latent heat of fusion, high density, possibility of supercooling, etc.

In order to obtain rapid solidification of a jet of liquid steel, it is therefore indispensable to use a very effective cooling fluid. For this purpose, it is favorable to use a gas which is a good conductor of heat (for instance, hydrogen, helium, carbon dioxide, nitrogen) to which a cooling liquid in subdivided form can be added. In this respect water, which has a high heat of vaporization and a high thermal capacity, used in the form of a mist, would seem particularly indicated.

However, it is not sufficient to use a vigorous cooling means. It is also necessary to initiate the solidification without delay, and in particular to combat supercooling phenomena, which problem has not been satisfactorily solved up to the time of the present invention. The present invention is directed precisely at initiating the solidification of the jet immediately upon its penetration into the cooling fluid so that it can progress sufficiently to fix the jet in its cylindrical shape before the jet has had time to be destroyed.

The method of the invention for the manufacture of a thin, continuous steel wire by solidification of a jet of liquid steel projected into a cooling fluid is characterized by the fact that the solidification is initiated and accelerated by the presence of oxygen in the cooling fluid and by the presence of silicon in the steel; the silicon content of the steel, with due consideration of the amount of manganese possibly present in the steel, being sufficient for solid silica to be the oxidation product which is principally formed.

As can be seen, the invention thus consists in operating in an oxidizing medium and in selecting the silicon and manganese contents of the steel in such a manner as to favor the precipitation of solid silica and not the formation of soluble complex silicates, this being done by using the Fe — Si — Mn — O equilibrium diagram.

If the contents of manganese and silicon in the steel, expressed in percentage by weight with respect to the iron content of the steel, are designated by x and y, respectively, then the equilibrium curve defining the zones of formation of silica and silicate can be defined by the equation:

$$y = 0.55\,x^2 - 0.18\,x + 0.1 \qquad (1)$$

which applies at a temperature close to 1550°C. and within the range of $0.5\% \leq x \leq 1.5\%$ and $0.2\% \leq y \leq 1.5\%$.

In accordance with the invention, for any value of $x$, $y$, must have a value greater than that given by equation 1 in order to favor the formation of insoluble silica in the steel.

Preferably a substantial excess of silicon ($y$) will be used and it will be selected between 0.5% and 3%, manganese ($x$) being between practically 0% and 1.5% and silicon ($y$) being greater than the value given by equation 1. The following compositions of steel which are entirely suitable may be indicated by way of example:

| y (% Si) | x(% Mn) |
|---|---|
| 0.7 | 0.7 |
| 1.2 | 1.1 |
| 1.5 | 1.2 |
| 2.4 | 1.4 |

Oxygen must be present in order to initiate and accelerate the solidification. However, while the silicon and manganese are included in the steel, the oxygen is contributed by the cooling fluid. One can employ oxygen mixed with the cooling fluid in the form either of pure oxygen or of air, provided, however, that an inert gas (helium, nitrogen) is used as cooling fluid. However, it is preferable to employ an oxidizing compound capable of giving rise to active oxygen at high temperature in contact with the jet of steel of high temperature or of directly producing an oxidation reaction. By way of example of suitable oxidizing compounds, water and carbon dioxide may be mentioned.

Of course, the content of oxygen or of oxidizing compound in the cooling fluid must be such that the oxygen contacted with the liquid steel is in a trace amount; it is not a question, as a matter of fact, of oxidizing the steel, and even less so of burning it, but rather of causing the formation of microprecipitations of silica, constituting so many solidification seeds.

The following table shows various compositions by weight of the steel, some of which satisfy the parameters set forth above and have given rise to the formation of a thin, continuous steel wire, while others do not satisfy the parameters indicated above and, under the same above stated conditions of operation, do not give rise to the formation of a thin, continuous steel wire. In both cases, hydrogen to which a water mist was added was employed as the cooling fluid.

| Example No. | % C | % Si(y) | % Mn(x) | Formation of a Wire |
|---|---|---|---|---|
| 1 | 0.25 | 0.37 | 0.40 | yes |
| 2 | 0.25 | 0.35 | 0.85 | no |
| 3 | 0.25 | 0.33 | 1.10 | no |
| 4 | 0.30 | 0.73 | 1.10 | yes |
| 5 | 0.30 | 0.75 | 1.38 | no |

-continued

| Example No. | % C | % Si(y) | % Mn(x) | Formation of a Wire |
|---|---|---|---|---|
| 6 | 0.30 | 1.20 | 1.70 | no |
| 7 | 0.60 | 0.30 | 0.40 | yes |
| 8 | 0.60 | 0.30 | 0.90 | no |
| 9 | 0.65 | 0.80 | 1.00 | yes |
| 10 | 0.65 | 0.80 | 1.34 | no |
| 11 | 0.65 | 1.22 | 1.26 | yes |
| 12 | 0.65 | 1.20 | 1.90 | no |
| 13 | 0.30 | 2.50 | 0.03 | yes |

The above tests clearly show the influence of the silicon and manganese contents. At times a very slight change in the composition of the steel is sufficient for the formation of a steel wire to become possible or impossible. In the absence of the mist of water or another source of oxygen, no steel wire is obtained.

As already indicated, it seems that, depending on the relative proportions of silicon and manganese in the steel, the oxidation product which is principally formed is either silica, which is solid at the temperature in question, or a complex silicate of manganese and iron, which is liquid at the same temperature. In conventional metallurgy, the silicon and manganese contents are selected in such a manner as to avoid inclusions of solid silica in the steel and favor the formation of silicates. The invention, on the other hand, selects the silicon and manganese contents in such a manner as to favor the formation and precipitation of silica either throughout the jet of liquid steel or on its surface. The presence of silica initiates and accelerates the solidification of the steel. This requires the presence of oxygen or an oxidizing compound or mixture capable of contributing oxygen in contact with the silicon-containing liquid steel. The silica thus formed acts as solidification initiator and accelerator.

The use of silicon and manganese in the relative amounts indicated furthermore has the advantage of imparting good mechanical properties to the steel wires, making them suitable for the manufacture of reinforcing elements which can be used in the manufacture of tires and other reinforced rubber articles.

It is understood that the scope of the present invention is not limited by the explanations which have been suggested for the mechanism of action of the silica. Whatever this mechanism may be, the basic point of the invention is the formation of silica obtained under oxidizing conditions at high temperature due to a suitable composition of the steel.

What is claimed is:

1. Thin, continuous steel wires of a diameter between 30 and 400$\mu$ having manganese ($x$) and silicon ($y$) contents, expressed in percentages by weight with respect to the iron content of the steel, such that for any value of ($x$) the value for ($y$) is greater than that given by the equation $$y = 0.55\,x^2 - 0.18x + 0.1$$

said steel wires having silica as the principal oxidation product therein.

2. Thin, continuous steel wires of a diameter between 30 and 400$\mu$ having manganese and silicon contents so selected from the Fe—Si—Mn—O equilibrium diagram that silica is the principal oxidation product therein.

* * * * *